US008371764B2

(12) United States Patent
Steverwald

(10) Patent No.: US 8,371,764 B2
(45) Date of Patent: Feb. 12, 2013

(54) HANDLE SANITIZER

(76) Inventor: Beverly Steverwald, Farmingdale, NY (US)

( * ) Notice: Subject to any disclaimer, the term of this patent is extended or adjusted under 35 U.S.C. 154(b) by 1474 days.

(21) Appl. No.: 11/998,588

(22) Filed: Nov. 30, 2007

(65) Prior Publication Data

US 2009/0142121 A1 Jun. 4, 2009

(51) Int. Cl.
*A46B 11/00* (2006.01)

(52) U.S. Cl. ..... 401/11; 401/9

(58) Field of Classification Search ..... 401/9–11, 401/263, 264, 202
See application file for complete search history.

(56) References Cited

U.S. PATENT DOCUMENTS

| | | | | |
|---|---|---|---|---|
| 3,352,623 | A * | 11/1967 | Sanet | 401/183 |
| 4,953,999 | A * | 9/1990 | Rivers | 401/9 |
| 5,641,232 | A * | 6/1997 | Frey | 401/11 |
| 6,247,865 | B1 * | 6/2001 | Russell et al. | 401/202 |
| 6,340,260 | B1 * | 1/2002 | Dao | 401/202 |
| 7,611,156 | B2 * | 11/2009 | Dunser | 280/33.992 |
| 2006/0267299 | A1 | 11/2006 | Dunser | |

FOREIGN PATENT DOCUMENTS

| | | |
|---|---|---|
| CA | 2417171 | 7/2004 |
| EP | 1552891 A1 | 7/2005 |
| GB | 2353943 A | 3/2001 |
| GB | 2417886 A | 3/2006 |

* cited by examiner

*Primary Examiner* — David Walczak
(74) *Attorney, Agent, or Firm* — Kilpatrick Townsend & Stockton LLP

(57) ABSTRACT

A sanitizer for cleaning a handle of a cart includes a cleaning member and a cover member in which the cleaning member is slidably disposed. The cleaning member includes an opening which is positionable against the handle and a cavity defined by space between walls of the cleaning member, where the cavity is adapted for storing fluid. The opening includes one or more ports for dispensing fluid, the one or more ports disposed about an axially extending surface of the opening of the cleaning member, whereby fluid is transferred from said cavity to the surface of the handle.

7 Claims, 6 Drawing Sheets

HANDLE SANITIZER

BACKGROUND

1. Field of the Invention

The invention relates to a hand sized sanitizer for handles of the type found on shopping carts and the like.

2. Description of the Prior Art

The best way to minimize the spread of harmful germs, such as microscopic bacteria, viruses, fungi and protozoa, is to limit contact with objects exposed to germs, as much as possible. Periodically wiping down frequently handled objects is another way to avoid the spread of germs. Soap and water are perfectly adequate for cleaning. For something stronger, an antibacterial soap may be used. It may not kill all the germs that can lead to sickness, but it can reduce the amount of bacteria on an object. Bleach or a diluted solution that contains bleach can be used, but soap and water may be applied afterwards so that the strong smell does not irritate, for example, the nose of a child.

One example of an object exposed to harmful germs is a well known shopping cart handle. It should be noted in particular, that many shopping cart manufacturers build their shopping carts in such a way so as to allow parents to place their children in the basket of the cart, facing the parent, with the child's feet hanging through openings located under the handle of the cart. This placement is conducive to having the child constantly grasp the handle of the cart while being pushed so that the child remains balanced and upright in the basket. The inevitable result is that the child's hands come into contact with the shopping cart handle and subsequently foreign harmful bacteria on numerous occasions, and ultimately find themselves in the child's mouth and touching their face.

While wiping a handle before use would be desirable, carrying proper cleaning implements is an arduous task for most people.

Various prior art patents and patent applications have been directed to cleaning shopping cart handles.

UK Patent Application GB 2471886A to Freeman, Barry James, discloses a Handle Cleaning Device. The device consists of 2 halves which snap together and an internal surface which contacts and cleans a handle.

UK Patent Application GB 2353943A to Brackstone, Richard discloses a Device For Wiping Elongated Handles. The invention disclosed in this application is similar to that disclosed in the above application. However, this application includes a wiping blade structure not disclosed in the above application.

Canadian Patent Application CA 2417171A1 Notidis, Leonidas C discloses a Cart Handle-Sanitizer. The sanitizer has an internal cavity, which stores cleaning fluid or gel. An open end of the sanitizer may be locked with a clip to hold the sanitizer around a cart handle. The user squeezes the sanitizer and the fluid or gel is forced onto an absorbent sponge through perforations. The sponge in turn contacts the handle surface.

European Patent Application EP 1552891A1, to Portalier, Rene discloses a Grip Cleaning Device and Trolley with the Device.

US Patent Application US 2006/0267229A1 to Kavesh, Sheldon, discloses A Sanitizing Apparatus for Shopping Cart Handles and Other Handles. The sanitizer has a rigid outer shell with a cavity for storing fluid therein. A button is disclosed for forcing cleaning fluid through dispensing rings and onto the cart handle.

In view of the prior art sanitizers, a sanitizer is needed that is easily portable and is, for example, not significantly thicker or longer than a modern car key.

SUMMARY OF THE INVENTION

A sanitizer for cleaning a handle of a cart is disclosed. The sanitizer includes a cleaning member and a cover member in which the cleaning member is slidably disposed. The cleaning member includes an opening which is positionable against the handle and a cavity defined by space between walls of the cleaning member, where the cavity is adapted for storing fluid. The opening includes one or more ports for dispensing fluid, the one or more ports disposed about an axially extending surface of the opening of the cleaning member, whereby fluid is transferred from the cavity to the surface of the handle.

DESCRIPTION OF THE DRAWINGS

Accompanying are figures which serve only to illustrate an example of the invention, in which.

DETAILED DESCRIPTION OF THE PREFERRED EMBODIMENTS

Figure 1:
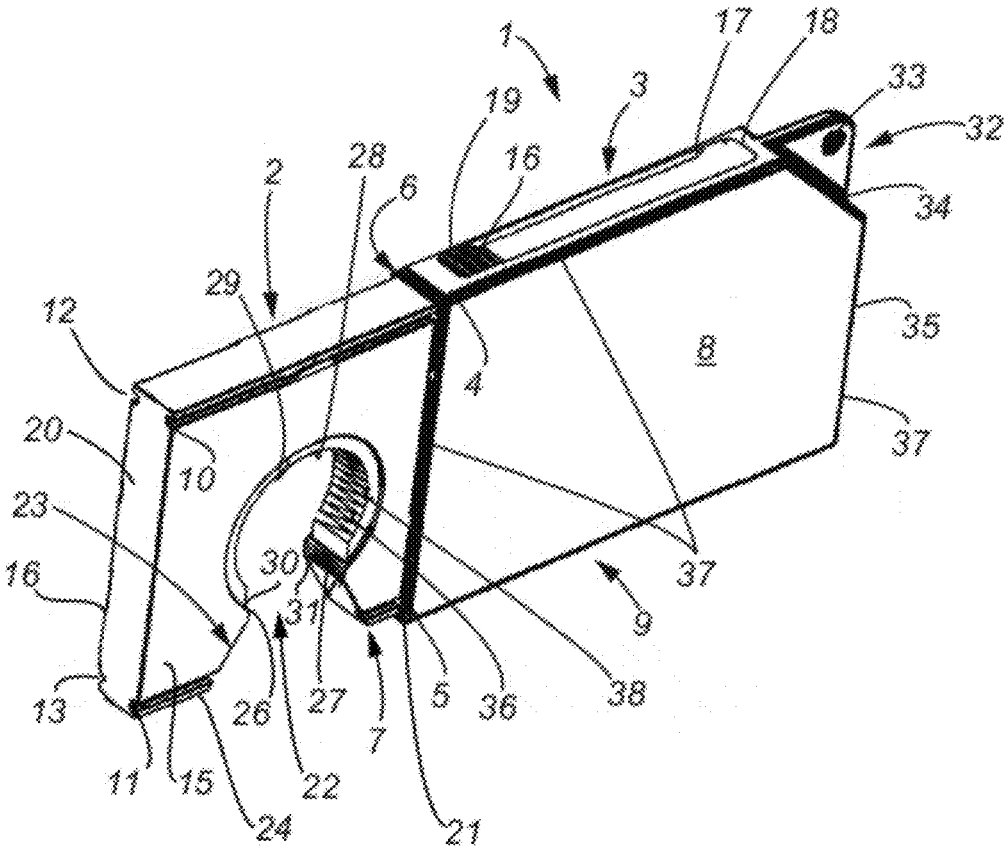
FIG. 1 is a perspective view of a first embodiment of the invention.

Turning to FIG. 1, a portable handle sanitizer 1 is illustrated. The sanitizer 1 includes a cleaning member 2 and a cover member 3.

The cleaning member 2 is slidably disposed within the cover member 3 so as to be concealed in the cover member 3. The fit of the cleaning member 2 within the cover member 3 allows for minimal friction between the members when the cleaning member 2 is slid within the cover member 3. As such, the cover member 3 will not accidentally slide off of the cleaning member 2 when stored in a pocketbook.

To accommodate the sliding relationship, the cover member 3 has a plurality of elongated protrusions or bosses 4-7. Two of the bosses 4, 5 are disposed on a first side 8 face of the cover member 3 and two of the bosses 6, 7 are disposed on a second side 9 of the cover member 3. Mating with the bosses 4-7 are plural matching groove tracks 10-13. Two of the tracks 10, 11 are disposed on a first side 15 face of the cleaning member 2 and two of the tracks 12, 13 are disposed on a second side 16 of the cleaning member 2. Together, the bosses 4-7 and grooves 10-17 serve as guide means for guiding the motion between the cleaning member 2 and the cover member 3.

The cleaning member 2 has a thumb actuator 16 which extends through an elongated slot 17 in a top edge 18 of the cover member 3. So that the cleaning member 2 is not extracted inadvertently, a top surface 19 of the thumb actuator 16 is flush mounted with the top edge 18 of the cover member 3. The longitudinal span of the slot 17 defines the maximum and minimum displacement of the front edge 20 of the cleaning member 2 as compared to the front edge 21 of the cover member 3. At minimum displacement, front edge 20 of the cleaning member 2 is flush with the front edge 21 of the cover member 3. Together, the thumb actuator 16 and the slot 17 serve as motion actuation means for actuating motion between the cleaning member 2 and the cover member 3.

The cleaning member 2 includes an opening 22 for cleaning the cart handle. A first contour 23 in the opening opens to a bottom edge 24 in the cleaning member 2. The first contour 23 is funnel shaped, having an essentially trapezoidal plan view. The minimum distance between opposing edges 26, 27 in the first contour 23 is at least as large as the diameter of the handle. This enables the opening 22 of the cleaning member 2 to fit over the handle without resistance. For example, the average handle has been measured to be approximately ⅝ of an inch in diameter so that the minimum distance between opposing edges 26, 27 is illustrated as being ⅝ of an inch. The first contour serves as guide means for guiding the handle into the opening 22 of the sanitizer 1.

A second contour 28 in the opening 22 is cylindrically shaped, having an essentially circular plan view. The shape enables an innermost portion 29 of the opening 22 to be positioned against a typical circularly shaped handle to clean the handle. The second contour 28 can be in any shape which enables the handle to be positioned within the opening 22 so that the sanitizer 1 can clean the handle. As illustrated, the second contour has a diameter of about an inch and a quarter, to allow for easy manipulation about a ⅝ of an inch diameter handle. As such, the second contour 28 serves as positioning means for positioning the opening 22 of the sanitizer 1 against the handle.

The guide portion as formed by the first contour 23 and the cleaning portion as formed by the second contour 28 are connected via opposing rounded edges 30, 31. The rounded edges 30, 31 enable the sanitizer opening 22 to slip over a handle without chipping the cleaning member 2, scratching the handle, or providing undue resistance when positioning the sanitizer 1 over the handle.

On the rear of the cover member 3 is a portion for engaging a key ring 32. The ring engaging portion includes a typical cylindrical opening 33 enabling the sanitizer 1 to fit on a key ring. The ring engaging portion 32 protrudes off of an angled edge 34, which is shaped as a chamfered edge as juxtaposed against adjacent edges 18 and 35 of the cover member 3.

As illustrated, the overall length of the sanitizer 1, with the cleaning member 2 fully extended from the cover member 3, is about five and a half inches. The overall length of the cover member 3 is about three and a half inches. The difference in length between the cleaning member 2 and the cover member 3 assures that cleaning member 2 has sufficient room to be retracted entirely into the cover member 3, taking into account the lost space in the cover member 3 due to the use of the angled edge 34.

The overall height of the cover member 3 is illustrated as being two and a half inches and the maximum thickness of the first case is about three-eighths of an inch. Such dimensions, along with the length dimensions, disclosed above, enable the sanitizer 1 to be easily portable on a key ring along with typical car keys or house keys as the sanitizer is not much larger than a typical business card. Those skilled in the art will recognize a range of possible dimensions for different applications, after reviewing the patent disclosure.

Both members 2 and 3 of the sanitizer 1 are fabricated, essentially uniformly, from 50 mil (0.050") thick plastic. This provides each wall of the sanitizer 1 with a greater strength than a typical credit card, which in comparison is fabricated from 40 mil thick plastic.

The key ring engaging portion 32 is solid and has a thickness that is approximately 150% of the wall thickness of the cover member 3, providing it with an illustrated a thickness of 0.125". This thickness provides the key ring engaging portion 32 with extra thickness to prevent it from tearing from the remainder of the cover member 3 and to prevent the material around the opening 33 from tearing during typical use.

The outer edge 37, extending around all surfaces of the cover member 3, is designed with a chamfer form to protect from scratching a user or tearing the clothing or articles of a user.

The exterior of the cover member 3, including the key ring holder 32, may be covered with a thin rubber coating. The rubber coating provides the sanitizer 1 with additional impact resistance as compared to the plastic material alone, increasing the usable life of the sanitizer 1.

The 50 mil wall thickness of each surface of the cleaning member 2 provides the cleaning member 2 with an internal cavity. This cavity is filled with cleaning fluid which is applied to the handle. The cavity in the cleaning member 2 may be filled and permanently sealed so that the sanitizer 1 has a finite useful life. Alternatively, the cavity in the cleaning member 2 may have an opening port (not shown) for refilling cleaning fluid therein to extend the useful life of the sanitizer 1. The cavity serves as fluid storage means for storing fluid within the sanitizer.

To communicate the fluid from within the cavity to the handle, one or more fluid ports are provided about the axially extending inner surface 36 of the opening 22 of the cleaning member 2. One of the ports is disposed at or near the innermost portion 29 of the cleaning portion 28. Such a port is pressure actuated for dispensing fluid, and can be of the type found in a Tide® To Go™ Instant Stain Remover 10 mL stain removing pen by Proctor & Gamble, Cincinnati, Ohio, 45202. Where at least three ports are used, they can be evenly distributed about the inner surface 36 of the innermost portion 29 of the opening 22, such as at 5-120 degree intervals.

Along with the dispensing ports, a sponge material 38 is disposed along the inner surface 36 of the opening 22 between a first opening edge and a second opening edge. The sponge material 38 absorbs up the dispensed cleaning fluid and serves dispersing means for dispersing the fluid about the inner surface 36 of the opening 22. With the use of the sponge 38, the cleaning fluid can be dispersed over a large surface area on the handle. Together, the fluid ports and the sponge 38 form cleaning means disposed on the positioning means for cleaning the surface of the handle.

Figure 2:
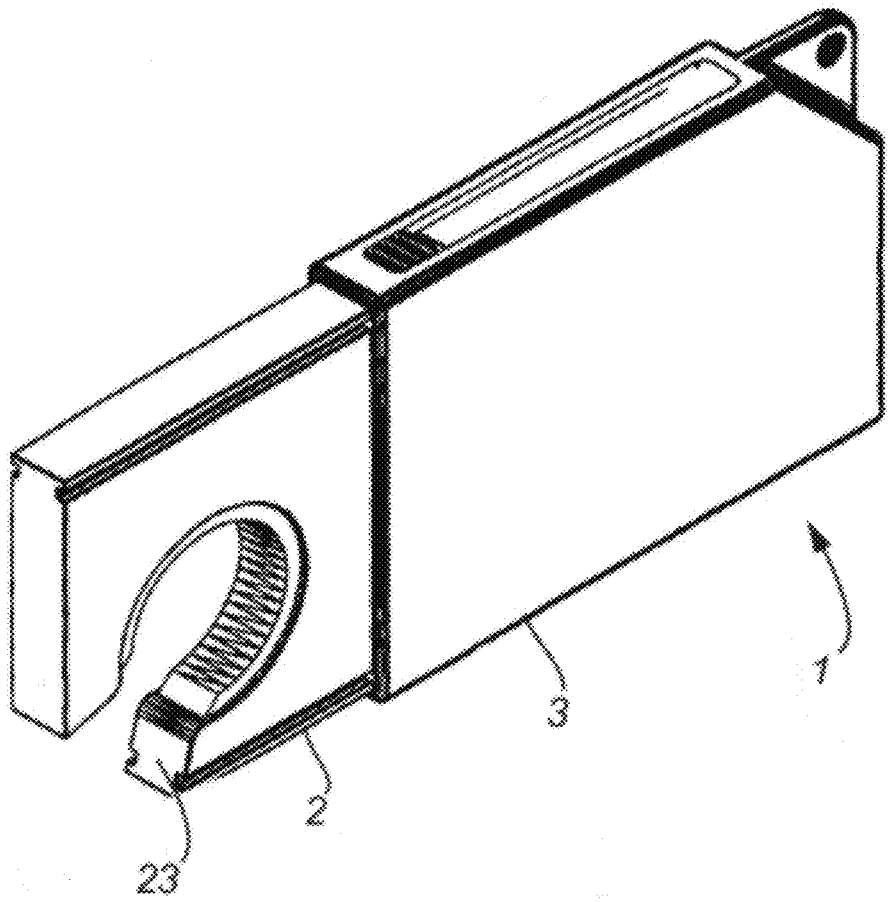
FIG. 2 is a perspective view of an alternative embodiment of the invention.

In an alternative embodiment, as illustrated in FIG. 2, the guide portion as formed by the first contour 23 has been rotated forty five degrees away from the cover member 3 as compared to the first disclosed embodiment. Yet alternatively, the guide portion as formed by the first contour 23 can be rotated ninety degrees as compared to the first disclosed embodiment. A user's comfort can dictate the position of the guide portion as formed by the first contour 23. For example, the location will alter how a person holds onto the sanitizer 1 and therefore the type of strain placed on the user's arm during application of the sanitizer 1. It will be appreciated that different people will prefer different configurations of the guide portion as formed by the first contour 23.

Figure 3:
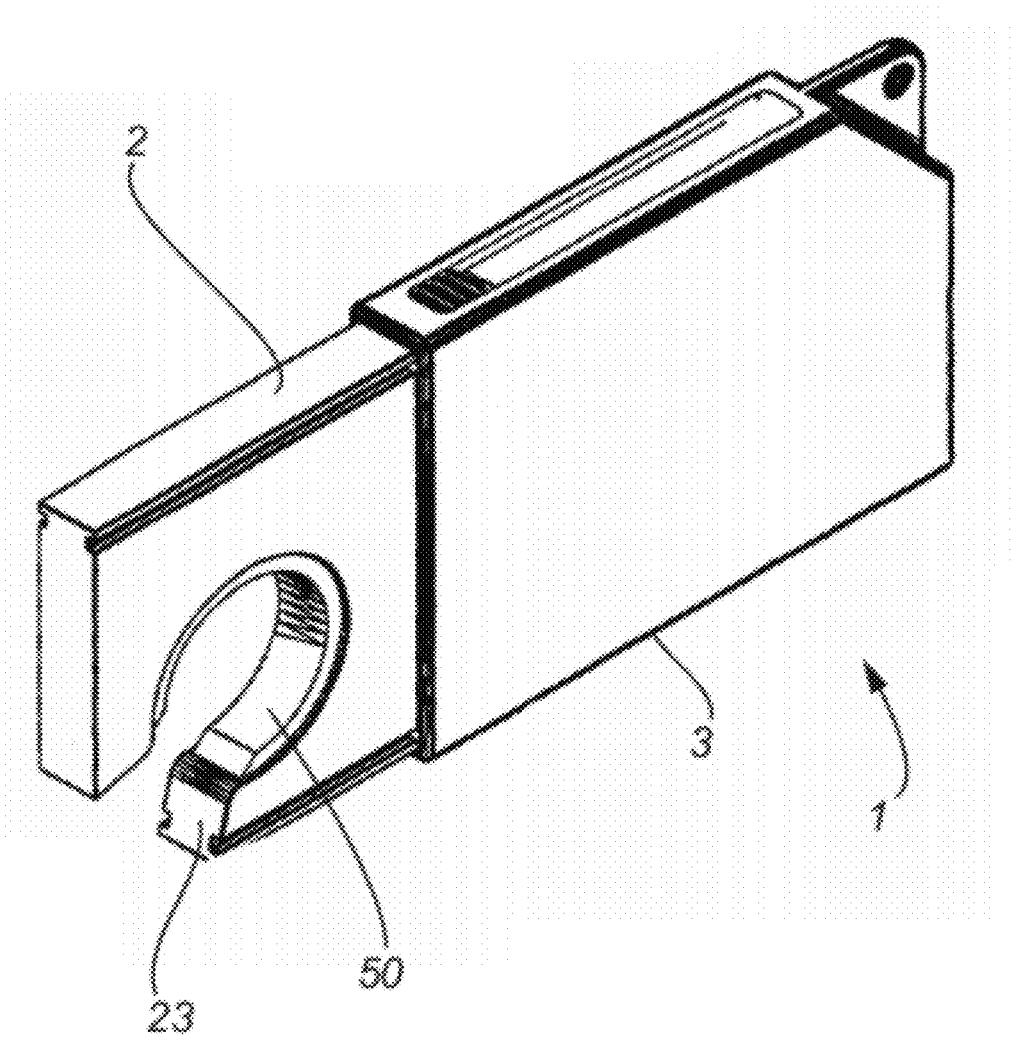
FIG. 3 is a view of a fluid port as disposed in the embodiment illustrated in FIG. 2.

An example of a location of the fluid port 50 is illustrated in FIG. 3. There, the sponge 38 is illustrated as being pulled back to expose the otherwise hidden fluid port 50.

Figure 4:
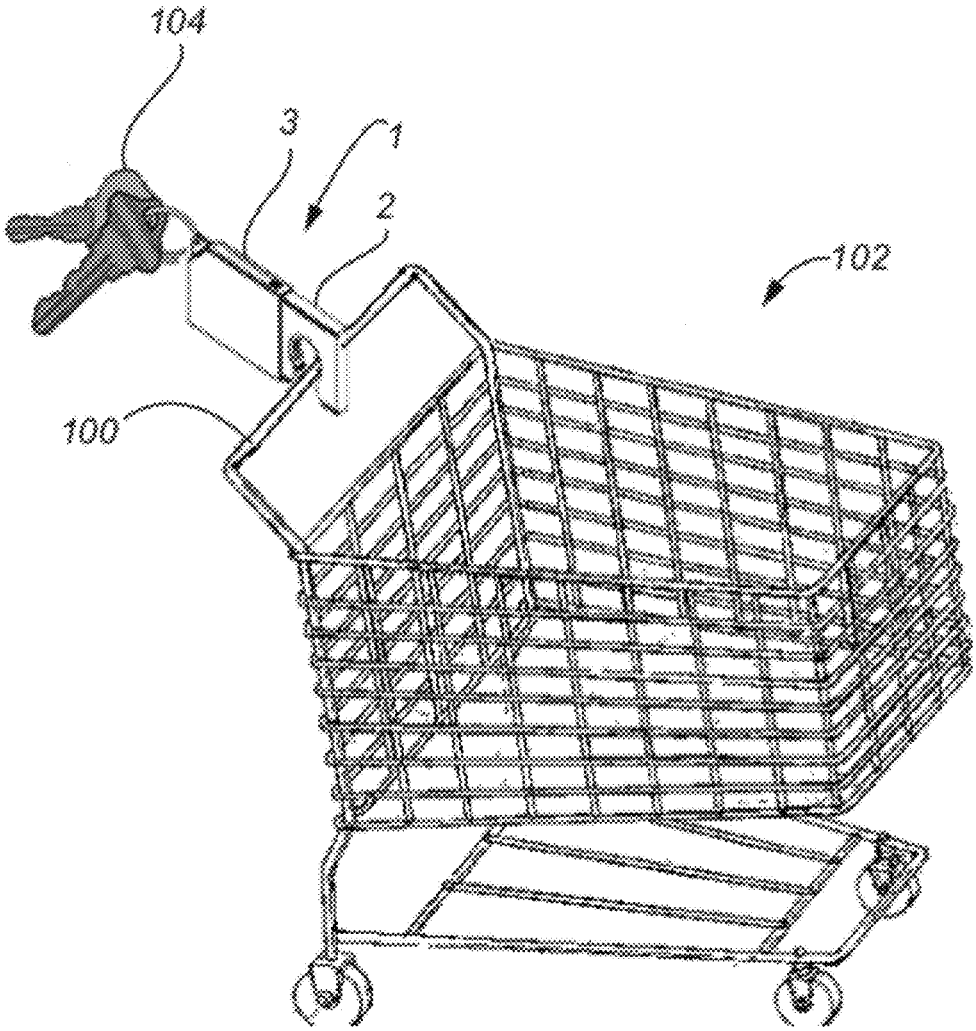
FIG. 4 is an illustration of an application of the invention illustrated in FIG. 1.

An illustration of the invention in use is provided in FIG. 4. The cleaning member 2 is withdrawn from the cover member 3. At this time, the user moves the guide portion as formed by the first contour 23 over a handle 100 of a shopping cart 102 until the innermost portion 29 of the opening 22 is disposed against the handle. Pressure from the handle 100 against the sponge 38 actuates the fluid ports 50 so that fluid is dispensed from the ports 50. Fluid is then absorbed into the sponge 38 and distributed around the handle 100 from continued application of pressure against the sponge 38. The sponge 38 disperses the fluid about the handle 100 to clean any one portion of the handle 100. The sanitizer 1 is slid along the handle 100 to clean the remainder of the handle 100. While the scale of the invention as compared to a typical shopping cart 102 a typical set of keys 104 may be in exact, the nature and application of the invention is clearly illustrated.

Figure 5:
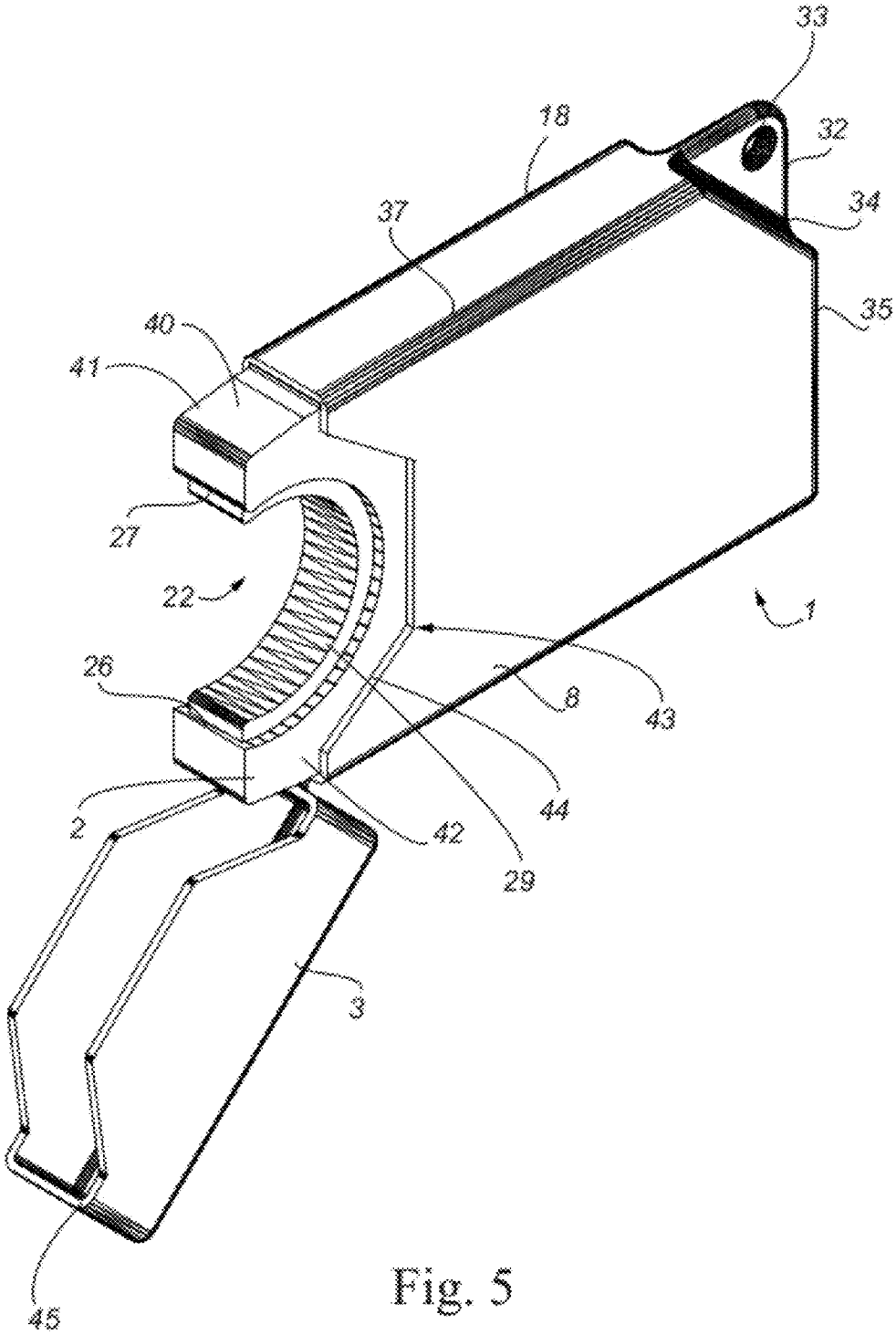
FIG. 5 is a perspective view of another embodiment of the invention in a first configuration.

Turning to FIG. 5, an alternative embodiment of the portable sanitizer 1 is illustrated. Here, the cover member 3 is pivotally connected to the cleaning member 2 so as to conceal a front end 40 of the cleaning member 2. A frictional fit is provided between the cover member 3 and the front end 40 of the cleaning member 2 due to outwardly angled opposing surfaces 41 and 42 located on extensions that extend outwardly from the front end 40 of the cleaning member 2. As a result, the cover member 3 steadfastly engages the cleaning member 2 when the cover member 3 is fully pivoted so as to enclose the front end 40 of the cleaning member 2. As such, the cover member 3 will not accidentally pivot off of the front end 40 of the cleaning member 2 when stored in a pocketbook.

The front end 40 of the cleaning member 2 includes a hemispherical opening 22 for cleaning the cart handle. The diameter of the opening, between opposing edges 26, 27, is at least as large as the diameter of the handle. This enables the opening 22 of the cleaning member 2 to fit over the handle without resistance. The shape also enables an innermost portion 29 of the opening 22 to be positioned against a typical circularly shaped handle to clean the handle. The contour of the opening need not be hemispherical but can be any shape which enables the handle to be positioned within the opening 22 so that the sanitizer 1 can clean the handle. As such, opening 22 serves as positioning means for positioning the sanitizer 1 against the handle.

On the rear of the cleaning member 2 is a portion for engaging a key ring 32. The ring engaging portion includes a typical cylindrical opening 33 enabling the sanitizer 1 to fit on a key ring. The ring engaging portion 32 protrudes off of an angled edge 34, which is shaped as a chamfered edge as juxtaposed against adjacent edges 18 and 35 of the cleaning member 2.

Figure 6:
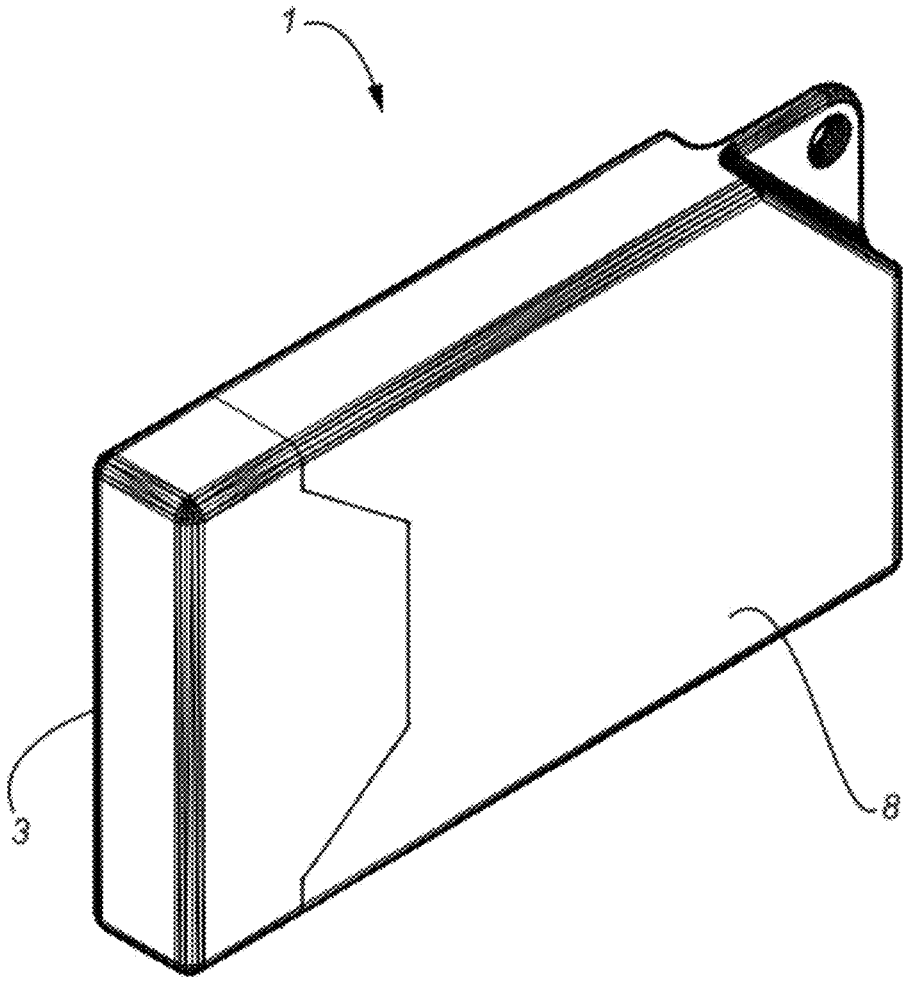
FIG. 6 is a perspective view of the embodiment illustrated in FIG. 4 in a second configuration.

As illustrated in FIG. 6, the overall length of the sanitizer 1, with the cover member 3 disposed over the cleaning member 2, is about three and a half inches. The overall height of the sanitizer 1 is illustrated as being two inches and the maximum thickness of the sanitizer is about half an inch. Such dimensions enable the sanitizer 1 to be easily portable on a key ring along with typical car keys or house keys.

As with the first embodiment, the cleaning member 2 of the sanitizer 1 is fabricated, essentially uniformly, from 50 mil thick plastic and the key ring engaging portion 32 is solid and has a thickness that is approximately 150% of the wall thickness of the walls of the cleaning member 2, providing it with an illustrated a thickness of approximately 0.125"Furthermore, similar to the first embodiment, the outer edge 37, extending around all surfaces of the cleaning member 2 and the cover member 3, is designed with a chamfer form. As with the first embodiment, the exterior of the cover member 3, including the key ring holder 32, may be covered with a thin rubber coating.

Differing from the first embodiment is that the cover member 3 is of a thinner material, such as 40 mil thick plastic. Furthermore, a step in thickness exists 43 around the front end 40 of the cleaning member 2. This step in thickness 43 is equivalent to the difference in wall thickness between the cover member 3 and the cleaning member 2. Furthermore, the respective mating edges 44, 45 of the cleaning member 2 and the cover member 3 are mirror images of each other. Accordingly, when the cover member 3 encloses the front end 40 of the cleaning member 2, the exterior is flush and smooth, without jagged or opened edges which can cause the cover member 3 to inadvertently open.

Finally, similar to the first embodiment, the cleaning member 2 is provided with an internal cavity having the same characteristics of the disclosed fluid storage means. The fluid is transferred from within the cavity to the handle using the cleaning means disclosed in the first embodiment.

In use, the cover member 3 is pivoted away from the cleaning member 2. At this time, the user operates this embodiment of the invention similarly to the first disclosed embodiment to clean the handle. As the cleaning member 2 will not engage the entire surface of the handle due to the hemispherical shape, the sanitizer 1 may be revolved about the handle to thereby clean the entire handle.

Accordingly, as compared to prior art sanitizers, each embodiment of the present invention is not significantly thicker or longer than a modern car key. Accordingly, the inventive sanitizer is easily portable as compared to prior art sanitizers.

While the discussion for each of the above embodiments has been directed to cleaning a cart handle, other objects which are hand held can be cleaned using the sanitizer 1. For example, the sanitizer may be used to clean a car steering wheel or other similarly shaped implement.

The above disclosure is not meant to limit the scope of the invention and merely discloses preferred embodiments thereof to enable one of ordinary skill to make and use without undue experimentation. Alternative embodiments within the scope of the invention which would be equivalent to one of ordinary skill are considered part of the invention and inherently disclosed herein.

I claim:

1. A sanitizer, comprising:

a cleaning member and a cover member pivotally connected to the cleaning member for covering and concealing a front portion of the cleaning member;

said sanitizer including fluid storage means for storing fluid within the sanitizer; and said front portion of the cleaning member comprising:

a pair of opposing extensions, wherein a first one of the extensions extends outwardly from a first side of the cleaning member and a second one of the extensions extends outwardly from an opposing side of the cleaning member;

an opening, wherein said opening is defined by a first opening edge and a second opening edge, wherein the first opening edge is positioned on an inner surface of the first one of the extensions and the second opening is positioned on an inner surface of the second one of the extensions, an inner surface of the opening is curved and extends from the first opening edge to the second opening edge, and wherein the inner surface is adapted for positioning against a handle;

at least one pressure actuated fluid port provided on the inner surface of the opening adapted for dispensing fluid from the fluid storage means; and sponge material provided on the inner surface of the opening, whereby the sponge material is adapted for dispersing the fluid dispensed from the fluid port onto the handle.

2. The sanitizer of claim 1, wherein said sanitizer further comprises key ring engaging means adapted for connecting said sanitizer to a key ring.

3. A sanitizer, comprising:

a cleaning member and a cover member pivotally connected to the cleaning member for covering and concealing a front portion of the cleaning member;

said sanitizer including a cavity defined by space between walls of the cleaning member, the cavity adapted for storing fluid; and said cleaning member having a top edge and a bottom edge said front portion of the cleaning member comprising:

a pair of opposing extensions, wherein a first one of the extensions extends outwardly from the top edge of the cleaning member and a second one of the extensions extends outwardly from the bottom edge of the cleaning member;

an opening for receiving a handle wherein said opening is defined by a first opening edge and a second opening edge, wherein the first opening edge is positioned on an inner surface of the first one of the extensions and the second opening edge is positioned on an inner surface of the second one of the extensions, an inner surface of the opening is curved and extends from the first opening edge to the second opening edge; and one or more pressure actuated fluid ports for dispensing fluid, the one or more ports disposed about the inner surface of the opening of said cleaning member, whereby fluid is adapted to be transferred from said cavity to the surface of the handle via the ports and sponge material provided on the inner surface of the opening when pressure is applied to the ports.

4. The sanitizer of claim 3 wherein said sanitizer further comprises an opening adapted for engaging a key ring and adapted for connecting said sanitizer to the key ring.

5. A sanitizer, comprising:

a cleaning member, wherein the cleaning member has a top edge and an opposing bottom edge and includes a fluid cleaning cavity; and a cover member connected to the cleaning member for covering and concealing a front portion of the cleaning member;

wherein the front portion of the cleaning member comprising:

a pair of outwardly angled opposing extensions, wherein a first one of the extensions extends outwardly from the top edge of the cleaning member and a second one of the extensions extends outwardly from the bottom edge of the cleaning member, and wherein the extensions are adapted to engage the cover member when the cover member covers and conceals the front portion of the cleaning member to maintain the cover member in a closed position;

a first opening edge and a second opening edge, wherein the first opening edge is positioned on an inner surface of the first one of the extensions and the second opening is positioned on an inner surface of the second one of the extensions, an inner surface of the front portion is curved and extends from the first opening edge to the second opening edge, and wherein there is an opening between the first opening edge and the second opening edge; and wherein the fluid cleaning cavity is connected to the inner surface of the front portion via at least one fluid port.

6. The sanitizer of claim 5, wherein the fluid cleaning cavity is defined by space between interior walls of the cleaning member.

7. The sanitizer of claim 5, wherein the sanitizer further includes a second opening adapted for engaging a key ring.

* * * * *